United States Patent [19]

Ueda

[11] 4,280,470

[45] Jul. 28, 1981

[54] THREE-STEP EXHAUST GAS RECIRCULATION CONTROL SYSTEM

[75] Inventor: Tatehito Ueda, Susono, Japan

[73] Assignee: Toyota Jidosha Kogyo Kabushiki Kaisha, Japan

[21] Appl. No.: 102,450

[22] Filed: Dec. 11, 1979

[30] Foreign Application Priority Data

Aug. 15, 1979 [JP] Japan ..... 54-104303

[51] Int. Cl.[3] ..... F02M 25/06

[52] U.S. Cl. ..... 123/569; 123/571

[58] Field of Search ..... 123/569, 571, 568

[56] References Cited

U.S. PATENT DOCUMENTS

| | | | |
|---|---|---|---|
| 4,157,081 | 6/1979 | Wake et al. | 123/569 |
| 4,181,109 | 1/1980 | Ware et al. | 123/569 |
| 4,192,267 | 3/1980 | Cobb | 123/569 |
| 4,237,837 | 12/1980 | Toda et al. | 123/569 |

*Primary Examiner*—Wendell E. Burns

*Attorney, Agent, or Firm*—Birch, Stewart, Kolasch & Birch

[57] ABSTRACT

An exhaust gas recirculation control system for particular application to a diesel engine, which has an exhaust gas recirculation control valve, and a means for actuating the exhaust gas recirculation control valve, which positions the exhaust gas recirculation control valve selectively and steppedly at one of three states, that are: a first state in which it provides substantially zero exhaust gas recirculation ratio, a second state in which it provides a medium exhaust gas recirculation ratio, and a third state in which it provides a maximum exhaust gas recirculation ratio, according to the load on the engine, so that the valve is steppedly shifted from the third state toward the first state via the second state as engine load increases.

7 Claims, 6 Drawing Figures

THREE-STEP EXHAUST GAS RECIRCULATION CONTROL SYSTEM

BACKGROUND OF THE INVENTION

The present invention relates to an exhaust gas recirculation control system, and, more particularly, relates to an exhaust gas recirculation control system which is particularly suited for application to a diesel engine.

The exhaust gas recirculation in diesel engines is to replace a part of the air inhaled into the cylinders of the engine that is generally in excess of that which is required for combustion of the fuel injected into the cylinders of the engine, by recirculated exhaust gas, in order to suppress emission of harmful NOx pollutants. In this diesel engine exhaust gas recirculation, it is desirable that the amount of air which is replaced by exhaust gas should be proportional to the amount of air which is in excess of the actual air requirement for combustion of the actual amount of fuel injected, so that maximum possible amount of excess air is reduced from the air/-gas flow supplied to the cylinders of the engine, without causing unstable combustion of fuel in the cylinders, while accomplishing maximum effect of suppressing NOx emission, over the entire operational region of the engine. Since the excess air ratio in the diesel engine decreases as the load on the engine increases, it is necessary to control the exhaust gas recirculation quantity so that the exhaust gas recirculation ratio decreases, as the load on the engine increases. The exhaust gas recirculation ratio is defined as the ratio of the quantity of exhaust gas recirculated and introduced into the inlet system of the engine so the total quantity of inlet gases inhaled by the engine, which is the sum of the quantity of the recirculated exhaust gases and the amount of fresh air inhaled by the engine.

The power output of or the load on a diesel engine is controlled by the amount of fuel injected per unit time, and, therefore, it is not generally possible, with a diesel engine, to perform control of exhaust gas recirculation, according to the load on the engine, by using a diaphragm operated type exhaust gas recirculation control valve which responds to inlet manifold vacuum, as is done commonly with gasoline engines. Accordingly, therefore, in the prior art, in a diesel engine the conventional exhaust gas recirculation control valve has been directly connected to and operated by either the accelerator pedal linkage of the vehicle, or the control lever of the fuel injection pump, so that the exhaust gas recirculation control valve has been operated according to the operation of the accelerator lever, or the control lever.

This form of control means for exhaust gas recirculation is fairly easy and simple to manufacture, but there is a problem that it tends to increase the amount of force required for manipulation of the accelerator pedal, and thereby may deteriorate the operational feeling of the accelerator pedal and therefore the drivability of the vehicle.

As an alternative system for controlling diesel exhaust gas recirculation, there has been proposed a system which comprises a diaphragm type exhaust gas recirculation control valve, the diaphragm device being actuated by vacuum provided by a pneumatic governor diaphragm chamber installed in the fuel injection pump. However, with this system of exhaust gas recirculation control, the problem arises that it is not really possible to obtain enough power for operating the exhaust gas recirculation control valve from the vacuum supplied by the pneumatic governor diaphragm chamber, because the vacuum present in this pneumatic governor diaphragm chamber is basically relatively small. Further, because of this, there arises the problem that the position of the exhaust gas recirculation control valve may be directly displaced by the dynamic pressure of the inlet air flow and/or the recirculating exhaust gas flow.

As another possible solution to the problem of diesel exhaust gas recirculation control, the possibility has been explored of controlling exhaust gas recirculation quantity continuously to the appropriate and correct value by measuring the amount of fuel injected to the combustion chambers of the engine per one cycle, and by opening and closing an exhaust gas recirculation control valve by a pressure type and/or electric type actuator, based upon these measurements. However, in this case, the control system as a whole becomes very complicated, and various problems occur when it is in practice mounted to an operating automobile.

SUMMARY OF THE INVENTION

The present invention arises from the remarking by the present inventor of the fact that, although theoretically and desirably the ratio of exhaust gas recirculation should be varied smoothly and continuously as the load on the engine varies, in actual practice this smooth variation is not strictly necessary for effective control, and in practice if the rate of exhaust gas recirculation were varied in a two step manner, this would provide a very satisfactory improvement in performance over ON/OFF control. That is, although the ideal curve of the relationship between engine load and exhaust gas recirculation ratio should be a smoothly curved line, nevertheless an approximation to this smoothly curved line by a two step bar chart, if it provides advantages with regard to simplicity, cost of manufacture and reliability of operation, may be acceptable.

Therefore, it is the object of the present invention to provide an exhaust gas recirculation control system, for a diesel engine, which is simple, and yet provides a performance of control of exhaust gas recirculation ratio which approximately satisfies the ideally required characteristics for exhaust gas recirculation.

This, and other, objects, are achieved, according to the present invention, in a diesel engine, comprising an exhaust system, an inlet system, and an exhaust gas recirculation system, by an exhaust gas recirculation control system, comprising: an exhaust gas recirculation control valve, which controls the amount of exhaust gas recirculated from the exhaust system of the engine to the inlet system through the exhaust gas recirculation system; and a means for actuating the exhaust gas recirculation control valve, which positions the exhaust gas recirculation control valve selectively and steppedly at one of three states, that are: a first state in which it provides substantially zero exhaust gas recirculation ratio, a second state in which it provides a medium exhaust gas recirculation ratio, and a third state in which it provides a maximum exhaust gas recirculation ratio, according to the load on the engine.

According to a particular feature of the present invention, the exhaust gas recirculation control valve actuating means may conveniently comprise a multi-action diaphragm actuator which includes first and second diaphragms which define first and second diaphragm chambers and a stem operatively related with the first and second diaphragms, the stem being located at a first shift position when either of the first and second diaphragm chambers is not supplied with operating fluid pressure, at a second shift position when only the first diaphragm chamber is supplied with operating fluid pressure, and at a third shift position when both the first and second diaphragm chambers are supplied with operating fluid pressure, and a fluid flow control means which controls supply of the operating fluid pressure to the first and second diaphragm chambers according to the load on the engine.

According to a further particular feature of the present invention, the operating fluid pressure supply control means may desirably comprise an electric switch which detects displacement of a fuel metering element such as a control lever, a control rack, or a spill ring of a fuel injection pump in three stages, and first and second electromagnetic valves which are controlled by the switch and control supply of the operating fluid pressure to the first and second diaphragm chambers, respectively.

According to another particular feature of the present invention, the operating fluid pressure which is controlled by the two electromagnetic valves may be a fluid pressure produced by a pump operated by the diesel engine.

Further, according to yet another particular feature of the present invention, the exhaust gas recirculation control valve may desirably be so adapted that, when exhaust gas recirculation ratio is increased, it further restricts the passage of intake fresh air. As, in a diesel engine, the vacuum present in the inlet manifold is relatively low (that is, the pressure therein is relatively near atmospheric) compared to that present in the inlet manifold of a gasoline engine, there is a possibility that the actual amount of exhaust gas recirculated cannot be increased by more than a certain amount, even when the exhaust gas recirculation control valve is quite wide open, if it is provided in the exhaust gas recirculation passage, especially when the engine load is low. On the other hand, if, as explained above, the intake air passage is more throttled, by the exhaust gas recirculation control valve, when the exhaust gas recirculation ratio is to be increased, the absolute amount of exhaust gas recirculated increases to approximately the same extent as the amount of inhaled fresh air is decreased. By this arrangement, even at low engine load, it is possible to obtain the necessary exhaust gas recirculation ratio, and the necessary amount of recirculation of exhaust gases.

BRIEF DESCRIPTION OF THE DRAWINGS

The present invention will become more fully understood from the following description of several preferred embodiments thereof, which is to be taken in conjunction with the accompanying drawings. It should be clearly understood, however, that the description of the embodiments, and the drawings, are all of them provided purely for the purposes of illustration and exemplification only, and are in no way to be taken as limitative of the scope of the present invention. In the drawings.

DESCRIPTION OF THE PREFERRED EMBODIMENTS

Figure 1:
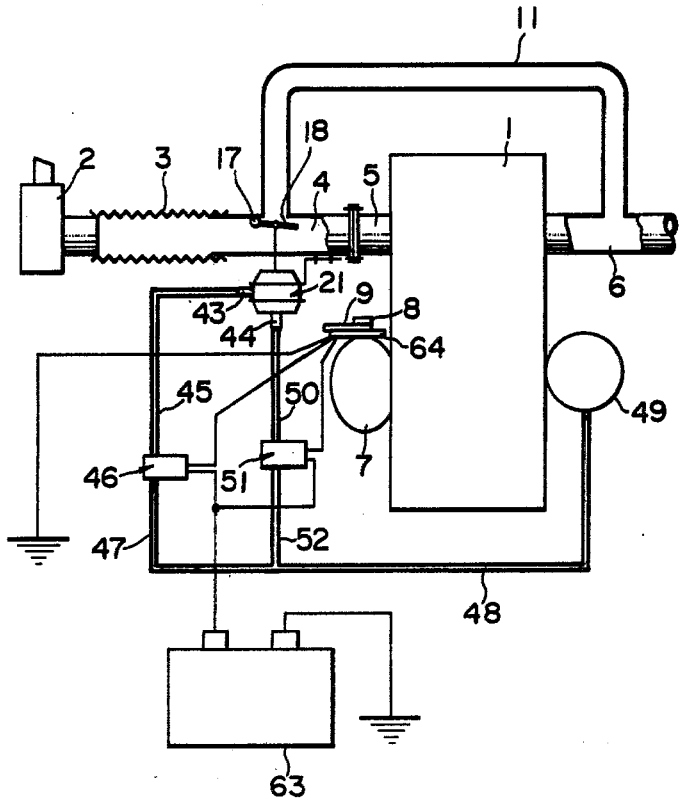
FIG. 1 is a somewhat schematic diagram, showing a diesel engine which is equipped with an embodiment of the exhaust gas recirculation control system of the present invention.

Referring now to the drawings, the reference numeral 1 denotes a diesel engine which inhales air through an air cleaner 2, an inlet duct 3, in which an exhaust gas recirculation control valve 4 is incorporated, and an inlet manifold 5, mixes with this air and combusts it in the combustion chambers, the fuel being injected directly into the combustion chambers by a fuel injection pump 7, and exhausts exhaust gases through an exhaust manifold 6.

Figure 3:
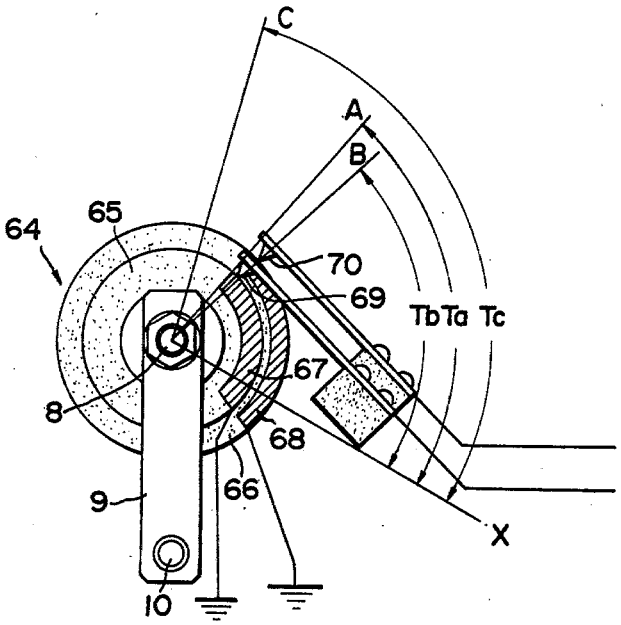
FIG. 3 is a side view particularly showing an electrical switching system incorporated in the exhaust gas recirculation system of the present invention.

Fuel injection valves corresponding to the various cylinders of the engine are incorporated in the engine so as each to be giving, on every compression stroke of the corresponding piston, a prescribed amount of liquid fuel, at high pressure, from the fuel injection pump 7, and to inject this prescribed amount of liquid fuel into the corresponding cylinder of the engine. The size of this prescribed amount of liquid fuel is regulated by the position of a control lever 9 of the fuel injection pump 7. One end of this control lever 9 is connected to one end of a shaft 8, as can be schematically seen in FIG. 1, and the shaft 8 extends into the fuel injection pump 7 and directly controls its output amount. The other end of this control lever 9 is pivotally connected by a pin 10 (FIG. 3) to the accelerator pedal (not shown) of the automobile in which this diesel engine is incorporated, through a linkage system which is not shown in the figures. When the accelerator pedal of the vehicle is depressed, the control lever 9 is rotated in the clockwise direction, as seen in FIG. 3, and this direction of rotation of the control lever 9 and the shaft 8 is in the direction of increasing the magnitude of the above mentioned prescribed amount of charge of liquid fuel supplied to each cylinder of the engine on its compression stroke.

Thereby, the load on the engine, that is to say, the amount of power developed by the engine, is increased, according to the clockwise rotation of the above mentioned control lever 9 or the associated shaft 8 of the fuel injection pump 7, due to the progressive depression of the accelerator pedal of the vehicle.

An exhaust gas recirculation passage 11 is provided with its one end connected to a middle portion of the exhaust manifold 6 and the other end connected to the exhaust gas recirculation control valve 4. Through this exhaust gas recirculation passage 11, a part of the exhaust gas produced by the diesel engine 1 is recirculated and directed to the inlet manifold 5, and the amount of flow of this exhaust gas is controlled in an ongoing fashion by the exhaust gas recirculation control valve 4.

Figure 2:
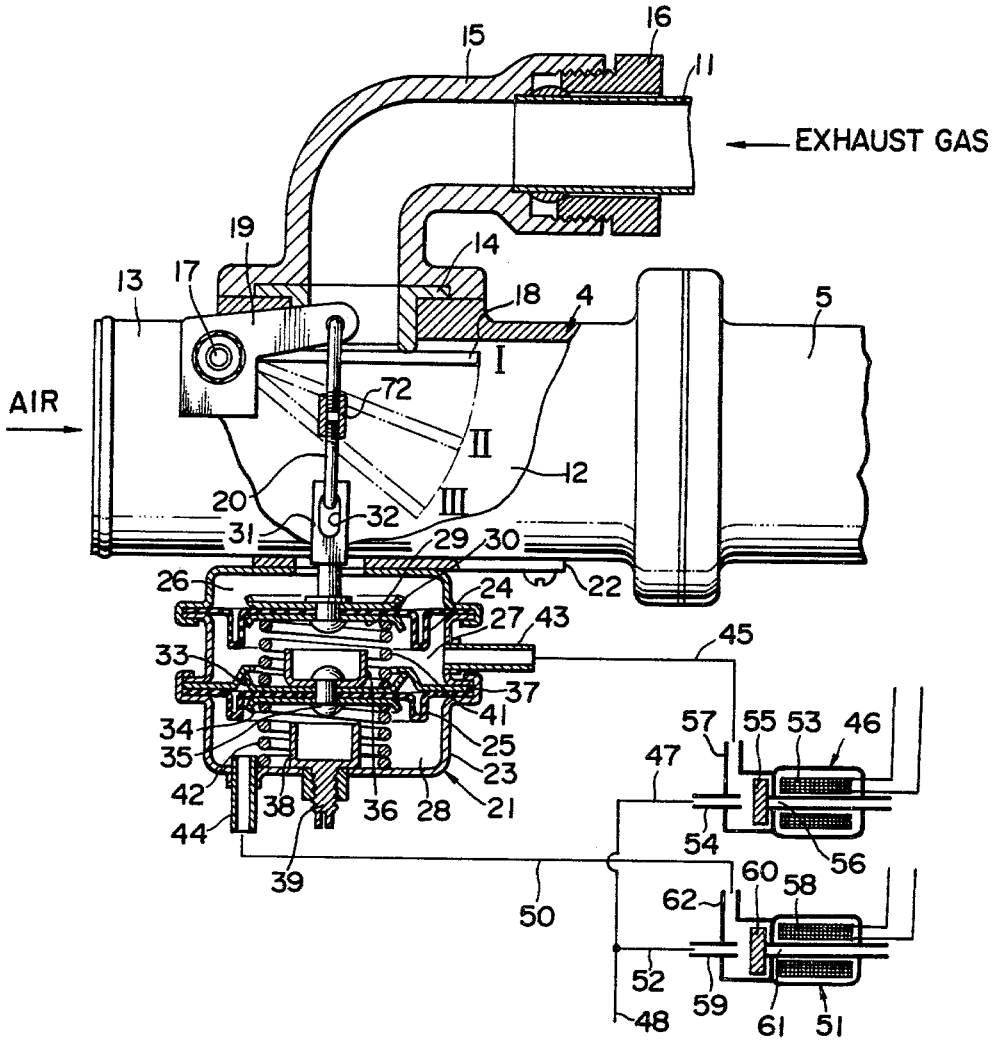
FIG. 2 is a sectional illustration of part of the embodiment of the exhaust gas recirculation control system of the present invention, which incorporates a flapper-type exhaust gas recirculation control valve, and of part of the intake duct of the diesel engine, showing their construction in detail.

Referring particularly now to FIG. 2, which shows the exhaust gas recirculation control valve 4 in more detail, this exhaust gas recirculation control valve 4, which in this embodiment is a flapper-type exhaust gas recirculation control valve, comprises a casing 13, which is generally connected between the inlet manifold 5 and the inlet duct 3, and which defines within itself an inlet passage 12, which connects the inlet duct 3 to the inlet manifold 5. On one side of this casing 13 (the upper side in FIG. 2), is connected an elbow pipe 15, which opens into the inlet passage 12 via an exhaust gas recirculation valve seat 14. The end of the elbow pipe 15 remote from the casing 13 is connected, by a nut 16, to an end of a tubular element which constructs the exhaust gas recirculation passage 11.

Further, the casing 13 supports rotatably a shaft 17, and on this shaft 17, inside the inlet passage 12, is fixedly attached one edge of the flapper valve element 18. Thus, this flapper valve element 18 is so adapted that it may move between a position, designated in FIG. 2 by I, in which it rests against the exhaust gas recirculation valve seat 14 and completely closes off the elbow pipe 15, and therefore the exhaust gas recirculation passage 11, from communication with the inlet passage 12, through an intermediate position, designated in FIG. 2 by II, in which it is partly moved away from this contact with the exhaust gas recirculation valve seat 14 so as to allow partial or restricted communication of the elbow pipe 15, and therefore the exhaust gas recirculation passage 11, with the inlet passage 12, to a third position, designated in FIG. 2 by III, in which it is moved so far away from contact with the exhaust gas recirculation valve seat 14 that the communication of the elbow pipe 15, and therefore the exhaust gas recirculation passage 11, with the inlet passage 12 is substantially free, with no substantial restriction being applied thereto by the flapper valve element 18. Further, according to a particular feature of this embodiment of the present invention, when the flapper valve element 18 is in this third position III, which is the full open position wherein the elbow pipe 15 and the exhaust gas recirculation passage 11 are substantially connected with the inlet passage 12 with no substantial restriction being applied therebetween, the flapper valve element 18 is also at this time providing substantial restriction to the flow of fresh air from the air cleaner 2, through the inlet duct 3, and through the inlet passage 12 to the inlet manifold 5.

The shaft 17 is biased in the anticlockwise direction in FIG. 2 by a twisted coil spring which is not shown in the drawings. Further, one one end of the shaft 17 (outside the casing 13) there is fixedly connected one end of a lever 19, and to the other end of this lever 19 there is pivotally connected one end of a connecting rod 20. The other end of this connecting rod 20 is connected to the multi-action diaphragm actuated control device 21, which will be explained hereinafter, and, as will be seen, by the action of the multi-action diaphragm activated control device 21, via the connecting rod 20, the lever 19, and the shaft 17, the flapper valve 18 is moved between its various positions I, II, and III. The length of the connecting rod 20 may be adjusted by an adjusting device 72, which adjusts its effective length.

The multi-action diaphragm activated control device 21 is fixed to the casing 13 of the exhaust gas recirculation control valve 4 by a mounting device 22. This multi-action diaphragm activated control device 21 comprises a first diaphragm 24 and a second diaphragm 25. These diaphragms 24 and 25 are fitted within a casing 23, in a stacked relationship, and, as seen in FIG. 2, the first diaphragm 24 defines an atomospheric pressure chamber 26 above itself, between itself and the casing 23. Further, between the first diaphragm 24 and the second diaphragm 25 and the casing 23, there is defined a first diaphragm chamber 27, and, further, the second diaphragm 25 defines a second diaphragm chamber 28 below itself, between itself and the casing 23.

An operating rod 31 is connected, at its one end, to the first diaphragm 24 by discs 29 and 30, and the other end of this operating rod 31 is connected to the connecting rod 20, via a slot 32, which allows a certain amount of free play between the connecting rod 20 and the operating rod 31. Further, the second diaphragm 25 supports, above it in FIG. 2, a first stopper 36, via discs 33 and 34, and a connecting member 35. Further, a fixed stopper plate 37 is mounted to the casing 23, above the second diaphragm 25, so that the second diaphragm 25 is prevented from moving upwards in FIG. 2 further than a certain predetermined position, by the coming into contact of the fixed stopper plate 37 and the disc 33, which is attached to the second diaphragm 25 on its upper side. Further, to the casing 23, below the second diaphragm 25, there is fixed a second stopper 38, which therefore restricts movement downwards in FIG. 2 of the second diaphragm 25 beyond another certain predetermined position. The position of this second stopper 38 may be adjusted in height and fixed in the vertical direction in FIG. 2 by the use of an adjusting screw 39.

Between the first diaphragm 24 and the second diaphragm 25 there is fitted a first compression coil spring 41, which bears between the disc 30 and the disc 33, and between the second diaphragm 25 and the lower part in FIG. 2 of the casing 23 there is fitted a second compression coil spring 42, both these compression coil spring 41 and 42 being fitted at a predetermined loading. Through the casing 23, there are fitted a first inlet port 43, which leads a fluid pressure (vacuum in this embodiment) the production of which will be explained hereinunder into the first diaphragm chamber 27, and a second inlet port 44, which leads another fluid pressure (also vacuum in this embodiment) the production of which will be explained later into the second diaphragm chamber 28.

The operation of this multi-action diaphragm activated control device 21 is as follows.

When vacuum is not supplied to either of the first inlet port 43 and the second inlet port 44, then neither the first diaphragm chamber 27 nor the second diaphragm chamber 28 is supplied with vacuum, but these diaphragm chambers 27 and 28 are both supplied with atmospheric pressure, and then, at this time, the multi-action diaphragm activated control device 21 is in the state shown in FIG. 2, by the biasing actions of the compression coil springs 41 and 42, and the flapper valve 18 is turned in the anticlockwise direction by the action of the spring (not shown), as seen in FIG. 2, so that this flapper valve 18 is kept in the full closed position I, as seen in FIG. 2, wherein it closes off completely the passage of recirculated exhaust gases. On the other hand, if vacuum which is greater than a predetermined value is introduced into the first diaphragm chamber 27 via the first inlet port 43, the first diaphragm 24 is moved downwards in FIG. 2 to a position where the disc 30 attached to its lower side is in contact with the first stopper 36, against the opposing spring force of the first compression coil spring 41, and thereby the lever 19 is rotated, via the operating rod 31 and the connecting rod 20, in the clockwise direction in FIG. 2, through a first predetermined angle. By this rotation of the lever 19, via the shaft 17, the flapper valve 18 is moved to the half open position, which is shown as II in FIG. 2, wherein the passage of recirculated exhaust gases is allowed at a certain intermediate amount.

Yet further, if vacuum which is greater than certain predetermined values is introduced into both the first diaphragm chamber 27 and the second diaphragm chamber 28 at the same time, via the first inlet port 43 and the second inlet port 44, respectively, then the second diaphragm 25 will move downwards in FIG. 2 to the position where the disc 34 attached to its lower side is in contact with the second stopper 38, against the spring force of the second compression coil spring 42, and also, as described above, the first diaphragm 24 will move downwards in FIG. 2 to the position where the disc 30 attached to its lower side is in contact with the first stopper 36, which is attached to the upper side of the second diaphragm 25. Thus, in this state, the first diaphragm 24 is moved to a lower position in the figure than was the case in the above described set of circumstances in which only the first diaphragm chamber 27, and not the second diaphragm chamber 28, was supplied with vacuum, and thereby the lever 19 is rotated, via the operating rod 31 and the connecting rod 20, in the clockwise direction through a second predetermined angle which is greater than the first predetermined angle described above. Thereby, via the shaft 17, the flapper valve 18 is moved in the clockwise direction to its full open position shown in FIG. 2 by III, wherein it substantially does not hinder the passage of recirculated exhaust gases.

Thereby, according to selective supply of vacuum to the first inlet port 43 or to both the first and second inlet ports 43 and 44 of the multi-action diaphragm activated control device 21, this multi-action diaphragm activated control device 21 provides a two-step performance of moving the flapper valve 18.

Supply of vacuum to the first inlet port 43 of the multi-action diaphragm activated control device 21, and therefore to the first diaphragm chamber 27 thereof, is provided, from a vacuum generating pump 49, which in this embodiment is coupled, as may be schematically seen in FIG. 1, to the diesel engine 1, via pipes 48 and 47, a first electromagnetic valve 46, and a pipe 45. Thus, by the opening and closing operation of the first electromagnetic valve 46, supply of vacuum may be selectively provided to the first diaphragm chamber 27 of the multi-action diaphragm activated control device 21. It should be noted that the first electromagnetic valve 46 is so adapted that, when it is not providing supply of vacuum from the pump 49 to the first inlet port 43 and the first diaphragm chamber 27 of the multi-action diaphragm activated control device 21, it is providing atmospheric pressure thereto instead.

Further, supply of vacuum to the second inlet port 44 of the multi-action diaphragm activated control device 21, and thereby to the second chamber 28 thereof, is provided, from the pump 49, via pipes 48 and 52, a second electromagnetic valve 5, and a pipe 50. Thereby, the vacuum generated by the pump 49 is selectively introduced to the second diaphragm chamber 28 of the multi-action diaphragm activated control device 21, under the control of the second electromagnetic valve 51. It should be noted that the second electromagnetic valve 51 is so adapted that, when it is not providing supply of vacuum from the pump 49 to the second inlet port 44 and the second diaphragm chamber 28 of the multi-action diaphragm activated control device 21, it is providing atmospheric pressure thereto instead.

The structure of the first and second electromagnetic valves 46 and 51 may be the same, and, in the shown embodiment, it is. Each of them has a valve element 55 or 60 which is movable to the right in FIG. 2, so as to block the atmosphere inlet port 56 or 61, by magnetic force generated by an electromagnetic coil 53 or 58, and which is also movable to the left in FIG. 2, so as to block the negative pressure port 54 or 59, by negative pressure which is present in the negative pressure port 54 or 59. This negative pressure port 54 or 59 is connected, via a pipe 47 or 52, to the pipe 48 which leads to the vacuum generating pump 49.

Thus, when the electromagnetic coil 53 or 58 receives supply of electric current, then it provides magnetic force, and the valve element 55 or 60 is attracted rightwards in FIG. 2, and thereby the negative pressure port 54 or 59 is communicated with the outlet ports 57 or 62, which is connected via the pipe 45 or 50 with the first inlet port 43 or the second inlet port 44 of the multi-action diaphragm activated control device 21, and further, by the rightward motion of the valve element 55 or 60, the atmospheric inlet port 56 or 61, which leads to the atmosphere, is closed.

On the other hand, when the electric coil 53 or 58 is not supplied with electric current, then it does not provide magnetic force, and thereby the valve element 55 or 60 is pulled leftwards in FIG. 2 by the vacuum which is present in the negative pressure port 54 or 59, and closes this vacuum negative pressure port 54 or 59. Therefore, the atmospheric inlet port 56 or 61 is communicated with the inlet port 57 or 62, and thereby, via the pipe 45 or 50, with the first inlet port 43 or the second inlet port 44 of the multi-action diaphragm activated control device 21.

The electromagnetic coils 53 and 58 of the first and second electromagnetic valves 46 and 51 are individually supplied selectively with electric current from a battery electric current source 63, under the control of an electric switching system 64, which is shown in more detail in FIG. 3. The electric switching system 64 comprises a first disc member 65 and a second disc member 66, which are both composed of insulating material, and which are fixedly attached to the shaft 8 of the diesel fuel injection pump 7. On the first disc member 65 and the second disc member 66 are mounted respectively a first contact plate 67 and a second contact plate 68, around parts of their circumferences, and these first and second contact plates 67 and 68 are made of electrically conducting material.

To one side of the shaft 8 are provided the first and second contact levers 69 and 70, which are electrically connected respectively to the coil 53 of the first electromagnetic valve 46, and to the coil 58 of the second electromagnetic valve 51, and which respectively bear upon the first contact plate 67 and the second contact plate 68, in a sliding and electrically conductive fashion. Further, the first contact plate 67 and the second contact plate 68 are grounded. Thereby, as the shaft 8 rotates to control the amount of diesel fuel provided to the cylinders of the engine by the diesel fuel injection pump 7, the first and second disc members 65 and 66 rotate, and the contact levers 69 and 70 slide along the contact plates 67 and 68, and establish electrical contact therewith, or break electrical contact therewith.

Thereby, the one ends of the coils 53 and 58 of the first and second electromagnetic valves 46 and 51 are selectively connected to ground. Further, as seen in FIG. 1, the other ends of these electric coils 53 and 58 of the first and second electromagnetic valves 46 and 51 are connected to the battery electric source 63. Thereby, according to the exact particular amount of rotation of the shaft 8 of the diesel fuel injection pump 7, one, both, or neither of the electromagnetic valves 46 and 51 may be energised.

In more detail, when the shaft 8 of the fuel injection pump 7 is in a position between the idling position of the pump, denoted by X in FIG. 3, and the position denoted by A, which is at a predetermined angle Ta away from the idling position X, the contact plate 67 is in electrical contact with the first contact lever 69, and thereby electrical power is supplied to the electromagnetic coil 53 of the first electromagnetic valve 46. Similarly, when the shaft 8 of the diesel fuel injection pump 7 is between the idling position of the pump X and the position denoted by B, which is at a second predetermined angle Tb away from the idling position X, said second predetermined angle Tb being a little smaller than the abovementioned first predetermined angle Ta, the second contact plate 68 is in electrical contact with the second contact lever 70, and thereby electrical power is provided to the electromagnetic coil 58 of the second electromagnetic valve 51.

Therefore, as the shaft 8 of the fuel injection pump 7 turns progressively between the idling position X and the engine full load or maximum power position C, which is at a third predetermined angle Tc away from the fuel injection pump 7 idling position, the operation of the electric switching device 64 is as follows.

First, when the shaft 8 of the fuel injection pump 7 is between the idling position X and the position B, which is at the angle Tb away from the idling position X, then the first contact plate 67 is in contact with the second contact lever 70. Therefore, electrical power is provided to both of the electromagnetic coils 53 and 58 of the first and the second electromagnetic valves 46 and 51. Thereby, the valve elements 55 and 60 of the first and second electromagnetic valves 45 and 61 are both attracted in the rightwards direction in FIG. 2, and thereby the negative pressure ports 54 and 59 are both communicated with their respective outlet ports 57 and 62, so that vacuum is provided from the pump 49 through the pipe 48, through both the pipes 47 and 52, through both the first and second electromagnetic valves 46 and 51, and through both the pipes 45 and 50 and the first inlet port 43 and the second inlet port 44, to both the first diaphragm chamber 27 and the second diaphragm chamber 28 of the multi-action diaphragm activated control device 21. Therefore, as described above, the multi-action diaphragm activated control device 21 opens the flapper valve 18 to its maximum open position, as shown in FIG. 2 by III, so that exhaust gas recirculation is performed to the maximum amount.

Further, according to the above described particular feature of this embodiment of the present invention, by the fact that in this condition the inlet passage 12 is restricted by the fully opened flapper valve 18, not only is the maximum amount of exhaust gas recirculation provided, according to the full open position of the flapper valve 18, but also the flow resistance of the inlet passage 12 to the flow of fresh air from the air cleaner 2 to the inlet manifold 5 is increased, and thereby the ratio of exhaust gas recirculation is further increased, which, as explained above, is very desirable.

Second, when the shaft 8 of the diesel fuel injection pump 7 is rotated beyond the position B, but not as far as the position A, so that the angle through which it has moved is greater than Tb but less than Ta, then the second contact plate 68 comes out of contact with the second contact lever 70, and only the first contact plate 69 remains in contact with the first contact lever 69. In this case, the electromagnetic coil 53 of the first electromagnetic valve 46 is provided with electrical power, and thereby its valve element 55 is moved rightwards in FIG. 2, thus communicating the negative pressure vacuum port 54 to the outlet port 57, and providing, via the pipe 45 and the first inlet port 43, the first diaphragm chamber 27 of the multi-action diaphragm activated control device 21 with vacuum from the pump 49, while, on the other hand, the electromagnetic coil 58 of the second electromagnetic valve 51 does not receive electrical power, and thereby its valve element 60 is moved leftwards in FIG. 2 and blocks the negative pressure port 59, while opening the atmospheric inlet port 61, whereby atmospheric pressure is introduced, via the pipe 50, and the second inlet port 44, to the second diaphragm chamber 28 of the multi-action diaphragm activated control device 21. Thereby, as explained above, the multi-action diaphragm activated control device 21 provides a position for the flapper valve 18, which is the intermediate or half open position denoted by II in FIG. 2, and thus reduces the amount of fluid flow of exhaust gas recirculation, as compared with the first situation described above, to an intermediate flow level.

Further, if the shaft 8 of the diesel fuel injection pump 7 is further rotated, beyond the angular position denoted by A, to a position between the angular position A and the angular position C, so that the angle through which it has moved from the idling position X is greater than Ta, then in this state the first contact plate 67 is out of contact with the first contact lever 69, and also the second contact plate 68 is out of contact with the second contact lever 70. Thereby, no electrical power is supplied to either the electromagnetic coil 58 of the second electromagnetic opening and closing valve 51. In this case, the valve elements 55 and 60 are both of them in their leftwards positions in FIG. 2, and thereby the negative pressure ports 54 and 59 are both closed, and the atmospheric inlet ports 56 and 61 are both open, whereby atmospheric pressure is introduced, via the pipes 45 and 50, and the first inlet port 43 and the second inlet port 44, to both the first diaphragm chamber 27 and the second diaphragm chamber 28 of the multi-action diaphragm activated control device 21. Thereby, as explained above, the multi-action diaphragm activated control device 21 provides a position for the flapper valve 18 which is the fully closed position, denoted by I in FIG. 2. Thereby, exhaust gas recirculation is effectively stopped.

Thus, it is seen that the electrical switching device 64 provides, selectively, a three-way signal, showing whether the amount of load upon the diesel engine, that is to say, the amount of fuel provided at each compression stroke of the piston of a cylinder of the engine to that cylinder by the diesel fuel injection pump 7, is either in a first region higher than a first predetermined value, in a second region between the first predetermined value and a second predetermined value, or in a third region below the second predetermined value. This three-way signal is acted on by the means which comprises the two electromagnetic valves 46 and 51, the multi-action diaphragm activated control device 21, and the exhaust gas recirculation valve 4, to provide a threeway performance of control of exhaust gas recirculation.

Figure 4:
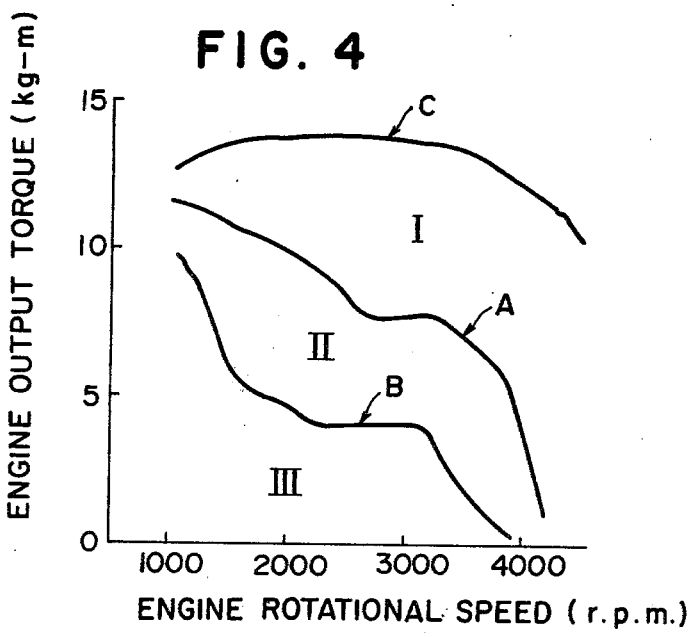
FIG. 4 is a graph, in which engine torque is the ordinate and engine rpm is the abscissa, showing an example of three lines A, B, and C, which divide from one another the three stages of operation I, II, and III, effected by the exhaust gas recirculation control system according to the present invention.

In FIG. 4 is shown a graph, in which engine torque is the ordinate and engine rpm is the abscissa, showing the characteristics of a diesel internal combustion engine, as regards the torque and rpm combinations provided by the above mentioned three positions of the shaft of the diesel fuel injection pump 7. Thus, the line denoted by A in FIG. 4 shows the various possible combinations of rpm and torque available when the shaft 8 of the diesel fuel injection pump 7 is at the position A in FIG. 3; the line denoted by B in FIG. 4 shows the various combinations of engine torque and engine rpm available when the shaft 8 of the diesel fuel injection pump 7 is at the position B in FIG. 3; and the line denoted by C in FIG. 4, similarly, shows the various possible combinations of engine torque and engine rpm available when the shaft 8 of the diesel fuel injection pump 7 is at the position C in FIG. 3, which is the full load position. As shown in FIG. 4, in the high load area I, which is located between the lines A and C, the flapper valve 18 of the exhaust gas recirculation valve 4 is in its fully closed position I, and exhaust gas recirculation is not performed. Further, in the area II of middle load, which is between the lines A and B, the flapper valve 18 of the exhaust gas recirculation control valve 4 is in its position II, wherein exhaust gas recirculation is performed to a moderate degree. Moreover, in the low load area III, which is the area below the line B in FIG. 4, the flapper valve 18 of the exhaust gas recirculation valve 4 is in its position III, and exhaust gas recirculation is performed at the maximum level.

Figure 5:
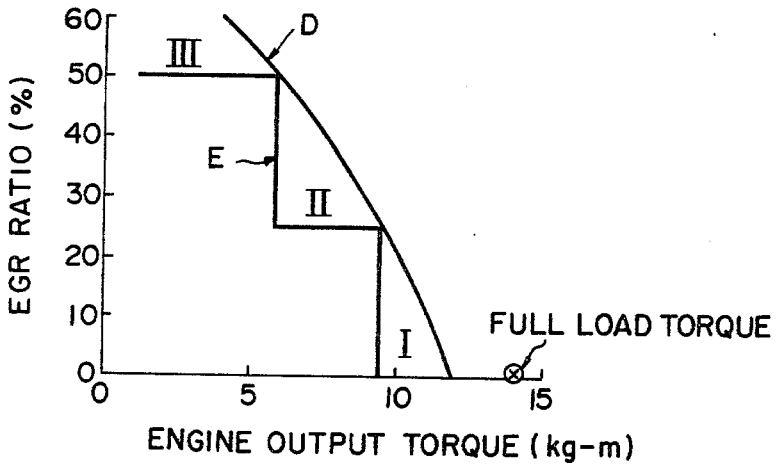
FIG. 5 is a graph, in which exhaust gas recirculation ratio is the ordinate and engine torque is the abscissa, showing an example of the three-stage performance of exhaust gas recirculation, effected by the exhaust gas recirculation control system of the present invention.

This performance is more clearly shown in FIG. 5, which is a graph, drawn for a representative fixed value of engine revolution speed, in which exhaust gas recirculation ratio is the ordinate, and engine torque is the abscissa, and in which the line designated by D is a line which shows the limit for effective exhaust gas recirculation. That is, if exhaust gas recirculation is performed at a higher amount, which is above the line D in FIG. 5, sufficient oxygen is not available for combustion of the fuel injected into the cylinders of the engine, and, problems arise with regard to the emission of HC, CO, and various other unburnt hydrocarbons, such as soot. Therefore, in order to maintain proper and ideal operation of the engine, the ideal amount of exhaust gas recirculation to be provided is shown by the line D in FIG. 5.

Therefore, this line D shows the ideal amount of exhaust gas recirculation for a particular combination of engine load and engine rpm. However, in practice, to arrange for an exhaust gas recirculation control means to provide exactly this amount of exhaust gas recirculation is, as explained above, excessively costly, and is prone to operational difficulties. Therefore, according to the present invention, exhaust gas recirculation is provided according to a characteristic shown by the line denoted by E in FIG. 5, as an approximation to the ideal performance of exhaust gas recirculation. The approximation provided by this line E is so arranged that it definitely never rises above the line D. This is so as definitely to eliminate the possibility of excessive production of HC, CO, and unburnt hydrocarbons such as soot in the exhaust gases of the diesel engine. At the same time, in view of the fact that the amount of exhaust gas recirculation provided by the exhaust gas recirculation control system of the present invention, according to the line E in FIG. 5, is substantially close to the line D, the reduction of emission of NOx by the device of the present invention is, substantially, acceptable. The three stages denoted by I, II, and III denote the three positions available for the flapper valve 18, as explained above with reference to FIG. 4. In the example shown in FIG. 5, the exhaust gas recirculation ratio in the fully closed position I is approximately 0%; the exhaust gas recirculation ratio provided in the part open position II is approximately 25%; and the exhaust gas recirculation ratio provided in the full open position III is approximately 50%.

In the shown embodiment, it is possible to adjust together the part open position II of the flapper valve 18 and the full open position III of the flapper valve 18, by adjusting the effective length of the connecting rod 20, by the operation of the length adjusting means 72, as explained above. Further, the full open position III of the flapper valve 18 can be altered independently of the part open position II of the flapper valve 18, by adjusting the position of the second stopper 38, by the use of the screw 39, as also explained above.

Figure 6:
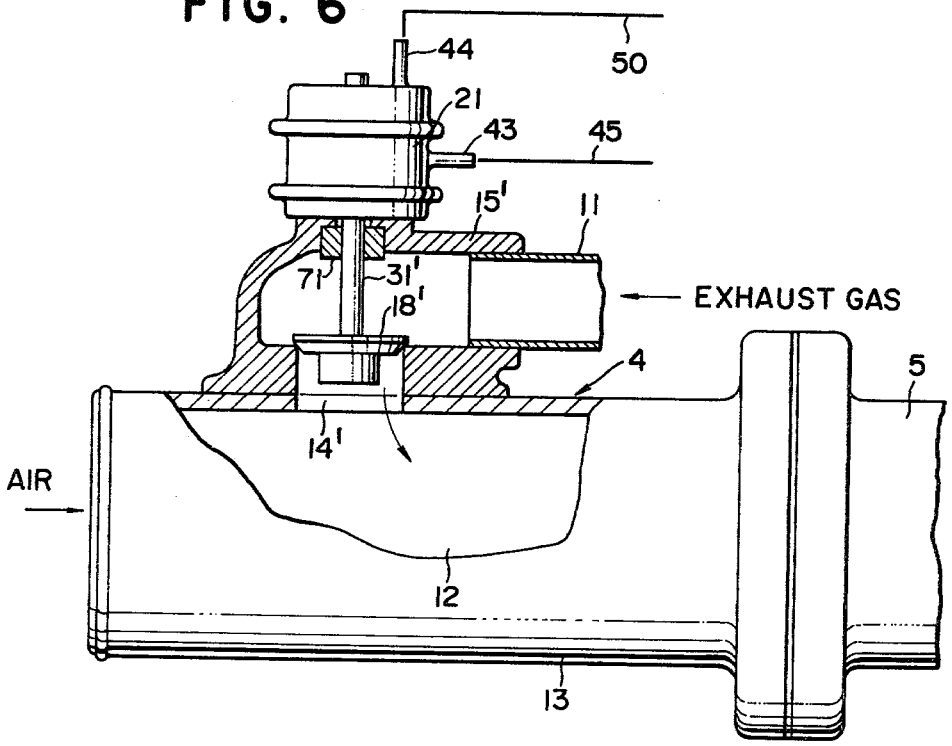
FIG. 6 is a view similar to FIG. 2, partially in cross section, of a second embodiment of the exhaust gas recirculation control device according to the present invention, in which a different type exhaust gas recirculation control valve is used.

In FIG. 6, a second embodiment of the exhaust gas recirculation control device according to the present invention is shown, in partial section. In this second embodiment, a disc-valve-and-seat-type exhaust gas recirculation control valve is used, instead of the flapper-type exhaust gas recirculation valve used in the first embodiment. In more detail, the exhaust gas recirculation control valve 4 is provided with a disc valve 18', which by its movement upwards and downwards in the figure opens and closes an exhaust gas recirculation control port 14', which is formed at the end of the elbow pipe 15'. This disc valve 18' is directly connected, via the rod 31', to the multi-action diaphragm activated control device 21, with sealing being performed by a seal member 71. Thus, the disc valve 18' is directly moved by the multi-action diaphragm activated control device 21.

The other illustrated parts in this embodiment correspond, respectively, to the parts of the first embodiment which are designated by the same reference numbers. Further, the parts of this second embodiment which are not shown are similar to those in the first embodiment.

The operation of this second embodiment is similar to the operation of the first embodiment. That is to say, when both the first inlet port 43 and the second inlet port 44 of the multi-action diaphragm activated control device 21 are supplied, not with vacuum, but with atmospheric pressure, then the disc valve 18' is in its lower position, as shown in FIG. 6, in which it fully closes the exhaust gas recirculation control port 14'. As explained above, according to the operation of the multi-action diaphragm activated control device 21 and the electrical switching system 64, this is the case when the engine load is higher than a first predetermined value. Further, when the first inlet port 43 is provided with a vacuum higher than a predetermined value, and the second inlet port 44 is not provided with vacuum, but is provided with atmospheric pressure, then the disc valve 18' rises in FIG. 6 to a certain extent, by a predetermined amount, so that the exhaust gas recirculation control port 14' is partly opened. In this position, an intermediate amount of exhaust gas recirculation is provided. This is the case, as explained above, according to the operation of the multi-action diaphragm operated control device 21 and the electrical switching means 64, when the load on the engine is lower than the second predetermined value, in other words, when the engine is operating in the low load region.

Thus, it is seen that the operation of this second embodiment is essentially similar to the operation of the first embodiment. However, it should be particularly noted that, in this second embodiment, the feature, which was present in the first embodiment, of the inlet duct 12 being somewhat restricted with regard to the flow of inlet air when the exhaust gas recirculation control valve 18 was in its fully open position III, is not present. Thus, in this second embodiment, the maximum amount of exhaust gas recirculation available does not provide such a high exhaust gas recirculation ratio as it would in the first embodiment. However, in view of other particular considerations, the second embodiment may be more applicable to certain situations. Further, it is also possible to obtain the effect of restricting the flow of inlet air, when the exhaust gas recirculation port is widely opened, by employing the disc-valve-and-seat-type valve, if the valve is so arranged that the valve element projects into the air inlet passage when it opens the exhaust gas recirculation port.

In various other possible embodiments, the electrical switching system 64 could be arranged differently. For example, this electrical switching system 64 might provide a three-way electrical control signal according to the varying position of a control rack which was provided to an in-line type diesel fuel injection pump. Alternatively, the electrical switching system 64 might provide its three-way signal according to the movement of the spill ring of a distributor type diesel fuel injection pump. In these cases, the control of exhaust gas recirculation can be done more precisely with reference to the engine load, because the switching action of the electrical switching device 64 can be performed without any influence from the characteristics of the governor of the fuel injection pump.

Although in the present embodiment the electrical switching device 64 produces an electric signal which is, effectively, a three-way electric signal (considering the combination of the two electric signals carried by the two wires which lead from the two contact arms 69 and 70 to the two coils 53 and 58 as a single three-way electrical control signal), this three-way electrical control signal might be provided in a different form. Analogously, although the control signals which are provided to the multi-action diaphragm actuated control device 21, which are fluid pressure signals, are in the shown embodiment provided as two independent fluid pressure signals, this is not essential, and it is only essential that a three-way fluid pressure signal should be provided to the multi-action diaphragm actuated control device 21; this three-way fluid pressure signal might take on a variety of forms, not being restricted merely to the pair of two-way fluid pressure signals, as in the shown embodiments.

Although the present invention has been shown and described in terms of several preferred embodiments thereof, and in language more or less specific with regard to structural features thereof, and with reference to the illustrative drawings, it should be understood that in any particular embodiment of the present invention various changes, modifications, and omissions of the form and the content of the present invention can be made by a person skilled in the art, without departing from its essential scope. Therefore, it is expressly desired that the scope of the present invention should be uniquely delimited by the legitimate and valid scope of the appended claims, which follow, and not by any of the perhaps purely fortuitous details of the shown embodiments, or of the drawings.

I claim:

1. In a diesel engine, comprising an exhaust system, an inlet system, and an exhaust gas recirculation system;

an exhaust gas recirculation control system, comprising:

an exhaust gas recirculation control valve, which controls the amount of exhaust gas recirculated from the exhaust system to the inlet system through the exhaust gas recirculation system; and a means for actuating the exhaust gas recirculation control valve, which positions the exhaust gas recirculation control valve selectively and steppedly at one of three states, that are: a first state in which it provides substantially zero exhaust gas recirculation ratio, a second state in which it provides a medium exhaust gas recirculation ratio, and a third state in which it provides a maximum exhaust gas recirculation ratio, according to the load on the engine.

2. An exhaust gas recirculation control system according to claim 1, wherein the exhaust gas recirculation control valve actuating means comprises a multi-action diaphragm actuator which includes first and second diaphragms which define first and second diaphragm chambers and a stem operatively related with the first and second diaphragms, the stem being located at a first position when either of the first and second diaphragm chambers is not supplied with operating fluid pressure, at a second shift position when only the first diaphragm chamber is supplied with operating fluid pressure, and at a third shift position when both the first and second diaphragm chambers are supplied with operating fluid pressure, and a fluid flow control means which controls supply of the operating fluid pressure to the first and second diaphragm chambers according to the load on the engine.

3. An exhaust gas recirculation control system according to claim 2, wherein the operating fluid pressure supply control means comprises an electric switch which detects displacement of a fuel metering element of the diesel engine, and first and second electromagnetic valves which are controlled by the switch and control supply of the operating fluid pressure to the first and second diaphragm chambers, respectively.

4. An exhaust gas recirculation control system according to claim 1, wherein, when the exhaust gas recirculation control valve is in its third state, it increases substantially the resistance to inhalation of air by the engine provided by the inlet system of the engine.

5. An exhaust gas recirculation control system according to claim 3, wherein the electric switch comprises two insulating discs which rotate according to the position of the fuel metering element, two contact plates, each mounted around part of the circumference of one of the discs, and two contact arms, each bearing slidingly against the circumference of one of the discs.

6. An exhaust gas recirculation control system according to any one of claims 1–5, wherein the exhaust gas recirculation control valve is a flapper-type exhaust gas recirculation control valve.

7. An exhaust gas recirculation control system according to any one of claims 1–5, wherein the exhaust gas recirculation control valve is a disc-valve-and-seat-type exhaust gas recirculation control valve.

* * * * *